US005104288A

United States Patent [19]

Groenendaal, Jr. et al.

[11] Patent Number: 5,104,288

[45] Date of Patent: Apr. 14, 1992

[54] DUAL PLANE BOLTED JOINT FOR SEPARATELY-SUPPORTED SEGMENTAL STATIONARY TURBINE BLADE ASSEMBLIES

[75] Inventors: John C. Groenendaal, Jr., Winter Springs; David M. Parker, Oviedo, both of Fla.

[73] Assignee: Westinghouse Electric Corp., Pittsburgh, Pa.

[21] Appl. No.: 625,172

[22] Filed: Dec. 10, 1990

[51] Int. Cl.[5] ..... F01D 9/00

[52] U.S. Cl. ..... 415/209.3; 415/134; 415/214.1; 285/330; 285/364; 285/406; 403/375

[58] Field of Search ..... 415/108, 134, 136, 137, 415/138, 183, 185, 190, 208.2, 209.3, 209.4, 214.1, 208.1; 285/330, 331, 364, 406; 403/375

[56] References Cited

U.S. PATENT DOCUMENTS

| | | | |
|---|---|---|---|
| 2,929,218 | 3/1960 | Yates | 415/108 |
| 3,741,680 | 6/1973 | Killmann et al. | 415/136 |
| 3,764,226 | 10/1973 | Matto | 415/136 |
| 3,945,760 | 3/1976 | Miller | 415/214.1 |
| 4,137,006 | 1/1979 | Becker | 415/214.1 |
| 4,816,213 | 3/1989 | Groenendaal, Jr. | 415/134 |
| 4,900,223 | 2/1990 | Groenendaal, Jr. | 415/190 |

FOREIGN PATENT DOCUMENTS

| | | | |
|---|---|---|---|
| 0960147 | 12/1974 | Canada | 415/134 |
| 0029083 | 6/1903 | Sweden | 285/331 |
| 0208681 | 12/1973 | United Kingdom | 415/136 |

*Primary Examiner*—Edward K. Look
*Assistant Examiner*—Christopher M. Verdier

[57] ABSTRACT

A steam turbine is disclosed which eliminates the transfer of thermal deformation from the inner cylinder to the stationary blade assemblies. A dual plane bolted connection and a free floating tongue and groove interface formed between the outer ring of the stationary blade assemblies and the turbine inner cylinder provided the clearance necessary to remove the deformation associated with the stationary blade assemblies, while supporting them within the turbine assembly. The outer ring of the stationary blade assemblies may either be formed as an integral component of formed from two sections which are then welded together. The present invention also permits the rotational blades of the turbine to be placed in close proximity to the outer ring of the stationary blade assemblies and the positioning of the flow guide on the outer ring, since the deformations due to the thermal deformation of the inner cylinder are now isolated and the deformation due to the stationary blade assemblies is eliminated. As a result, the dimensions of these components are more precisely controlled and result in a more efficient and economical steam turbine.

7 Claims, 4 Drawing Sheets

DUAL PLANE BOLTED JOINT FOR SEPARATELY-SUPPORTED SEGMENTAL STATIONARY TURBINE BLADE ASSEMBLIES

The present invention relates to steam turbines and, more precisely, relates to methods and apparatus for supporting stationary turbine blades.

BACKGROUND OF THE INVENTION

Frequently encountered problems, such as loss of efficiency during the operation of steam turbines, are in many instances caused by thermal deformation of the turbine inner cylinder. In many current turbine designs, thermal deformation is transferred to the blade assemblies through the hard connection created by locking devices or other means of firmly attaching the blade assemblies to the inner cylinder. The stationary blade assemblies are subject to thermal deformation caused by the inner cylinder and assume an oval shape, a condition referred to as "ovality." In certain cases, such an out-of-round condition can also be caused by a lack of continuity within the turbine assembly, i.e., from the top half-section of the blade ring to the bottom half-section of the blade ring. Pressure loading and thermal gradients cause the end of each half-section to spread and deflect radially, causing "ovality" and similar clearance problems to those encountered in assemblies connected by locking devices.

When ovality occurs, the clearances in the turbine assembly are altered and steam leakage and decreased efficiency result. The potential for mechanical interference with the rotor is created as well. Presently, to account for the dimensional changes due to thermal deformation, the inner cylinder and the rotating blades are manufactured using larger than optimum clearances, creating a designed-in source of steam leakage and a resulting in lower overall efficiency than would otherwise be achieved.

An additional problem is that the welds joining the stationary blade foils and the inner and outer turbine rings may sometimes crack due to vibrations generated during operation. In present turbine designs, the welded stationary blade assemblies cannot be accurately tuned or otherwise adjusted to avoid matching the operating speed with the natural frequency of the turbine, and harmonic vibration occurs. For example, it has been found that the natural frequency of some nuclear turbine blade assemblies which experienced cracking was at or near the turbine running speed of 30 Hz.

Therefore, it would be desirable to isolate or detach the welded stationary blade assemblies from the turbine inner cylinder to prevent the thermal deformation of the inner cylinder from being transferred to the welded blade assemblies. By providing such detachment, thermal and pressure deformations from the inner cylinder would not be passed to the welded blade assemblies, such that ovality and other deformations which previously resulted in decreased efficiency and increased turbine down time can be prevented.

Additionally, it would be desireable to provide a turbine assembly having stationary turbine blade assemblies which can be optimally controlled in terms of both maintaining appropriate clearances and controlling vibratory frequency. As explained above, present designs require an extra clearance margin to account for ovality and other deformation. However, since the degree of such deformation cannot be exactly calculated, a loss of efficiency, as well as an inability to harmonically balance the turbine results, since clearances remain which are too large, even during operation.

SUMMARY OF THE INVENTION

Accordingly, it has now been found that a steam turbine can be constructed which isolates the welded stationary blade assemblies from the turbine inner cylinder without the use of a separate turbine blade ring and thereby prevents the transfer of thermal deformation from the inner cylinder to the welded stationary blade assemblies. The present invention provides tongue and groove supported, separate and free-floating stationary blade assemblies which are not subject to deformation or restraint from the inner cylinder. In a preferred embodiment, the present invention also provides a dual plane bolted joint to attach the half-sections of the stationary blades together. Improved performance and efficiency result through greater product reliability, and cost reduction is achieved through better access for repair, maintenance and inspection. The support system of the present invention also simplifies the support of the welded assemblies while providing these advantages. Additionally, the present invention makes it possible to more accurately calculate and tune the natural frequency of the blade assemblies to avoid undesirable vibration modes from occurring at operating speeds.

The present invention provides a steam turbine comprising a plurality of stationary blade assemblies, a plurality of rotational blades, and an inner cylinder having a plurality of circumferential raised tongues. Typically, the stationary blade assemblies nearest the exhaust are made up of an inner ring, an outer ring and have a plurality of blade foils affixed between the inner and outer ring sections. Preferably, to promote pressure sealing on the upper face, a groove is formed in the outer ring section, and when the blade assemblies are disposed within the inner cylinder, the tongue and groove connections are assembled together leaving a clearance which substantially eliminates the transfer of deformation from the inner cylinder by creating a free-floating interface with freedom to move in the radial direction.

In certain embodiments, the present invention utilizes either an outer ring section which is an integral machined assembly or an outer ring section which is a welded assembly, comprising an outer section and an inner section joined by one or more substantially continuous circumferential welds. In either of these embodiments, the outer ring preferably comprises at least two sections which have mating surfaces joined by a bolted connection. The mating surfaces of the bolted connection are preferably disposed in two planes of engagement, most preferably at least one, the plane of the bolted connection itself, being aligned with the horizontal axis of the turbine, and another being typically disposed at an angle of between about 40 degrees and 50 degrees from the horizontal axis. The plane of engagement disposed at an angle may either comprise a smooth surface or may itself comprise one or more changes in orientation or structure which create features, indentations or other surfaces which tend to securely join the opposing faces of the outer ring sections.

In certain embodiments, the steam turbine of the present invention also has a flow guide affixed to the outer ring of the last row of blades and provides a structure permitting the stationary blade assemblies to be supported by conventional detachable support keys.

The present invention also permits the tip of the rotational blades to be in close proximity to the outer ring. By permitting an accurate assembly and maintaining close tolerances between the blades and the outer ring, the present invention provides improved performance and efficiency which could not be achieved using prior art designs.

The present invention therefore provides novel separate and free floating welded blade assemblies which are joined using a horizontal, dual plane bolted joint. The present invention preferably uses a welded stationary blade assembly supported and aligned using conventional support keys and alignment dowels, similar to those found in separately supported blade rings. Finally, the present invention provides the capability to attach exhaust flow guides directly to the separately supported blade assemblies, as opposed to the attachment of the flow guide disclosed in the prior art.

DETAILED DESCRIPTION

Figure 1:
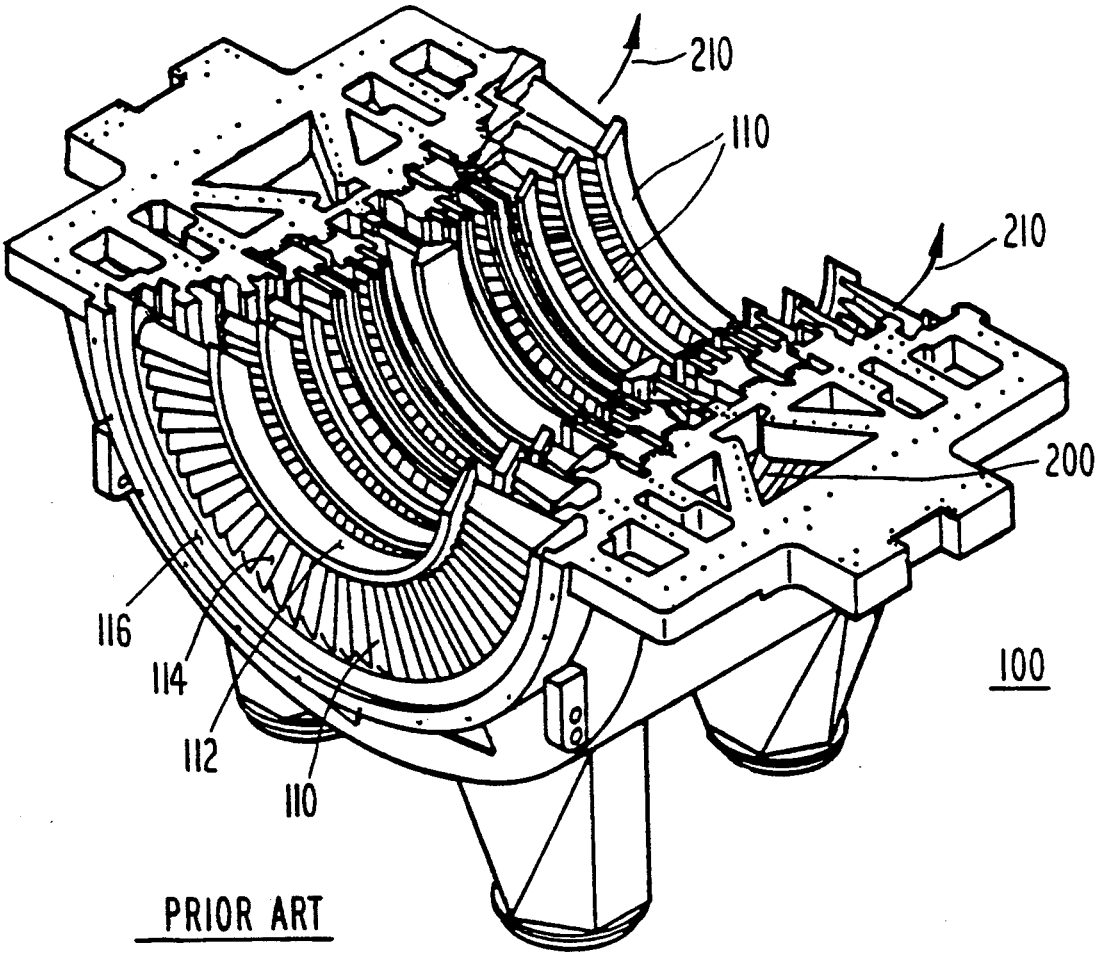
PRIOR ART Fig. 1
FIG. 1 is an isometric view of a plurality of stationary blade assemblies assembled into the lower section of an inner cylinder of a typical steam turbine.

Referring to FIG. 1, there is shown a typical half-section 100 of the inner cylinder base of a steam turbine. Within the lower half of a turbine assembly 100 shown, a plurality of stationary welded blade assemblies 110 are visible. A typical stationary blade assembly 110 comprises an inner ring section 112, a plurality of stationary blade foils 114 and an outer ring section 116. Each stationary blade assembly 110 is about one-half of a full circle, i.e., 180° and thus two of these segmental assemblies are attached to form a full row of stationary turbine blades in a steam turbine assembly. While in some instances the stationary blade assemblies 110 may be divided differently or even unequally, 180° segments are typical.

Figure 2:
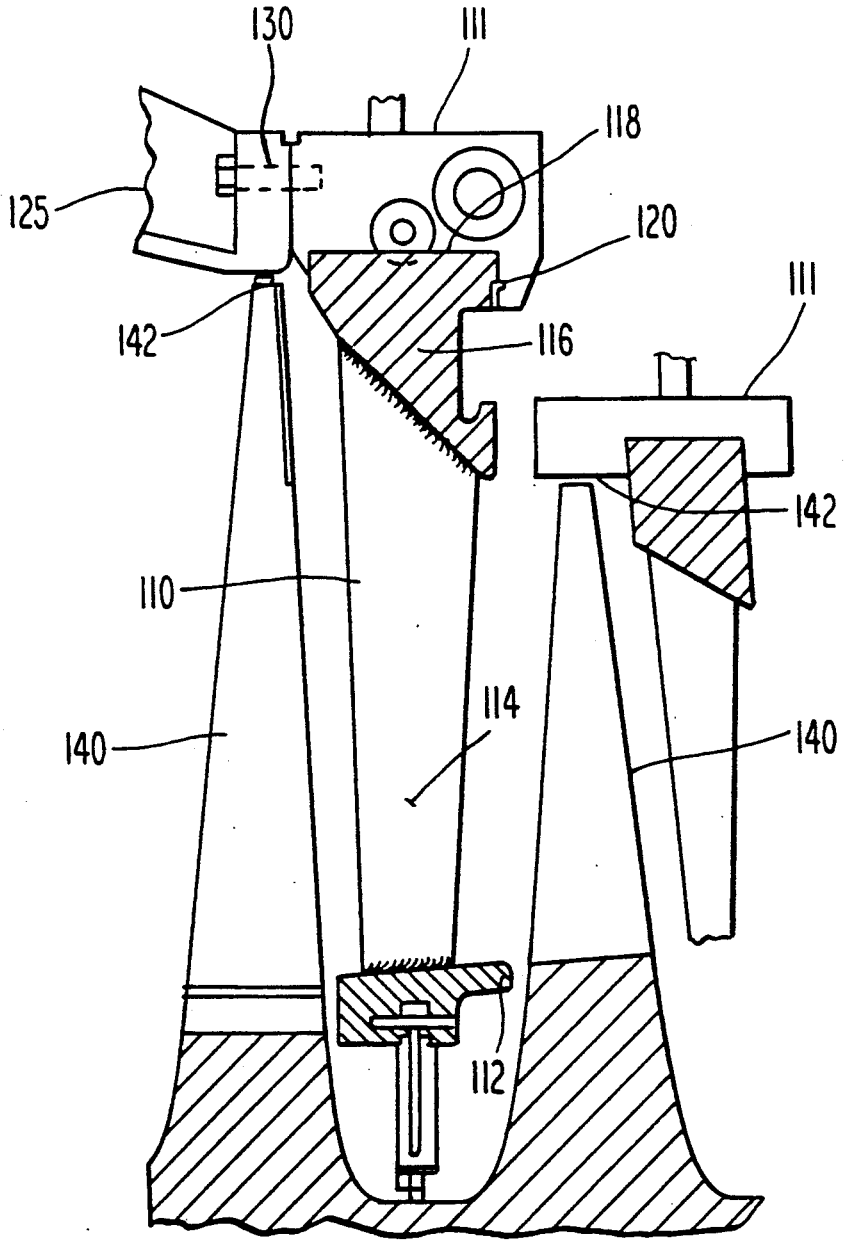
PRIOR ART Fig. 2
FIG. 2 illustrates a partially broken away view of a typical stationary blade assembly affixed to an inner cylinder by caulking.

In the first several rows of blades near the steam inlet chamber 200, stationary blade diaphragms supporting the blade foils 114 are held in separate blade rings. However, as seen in FIG. 2, in the last two or three blade rows near the exhaust outlet 210, (shown in FIG. 1) the stationary blade foils 114 are welded to the inner and outer rings 112, 116 due to their relatively larger size. In turn, the outer rings 116 are affixed into the inner cylinder 111.

Referring again to FIG. 2, a partially broken away view of a typical welded stationary blade foil 114 and the inner and outer rings 112, 116 to which it is affixed are shown. The conventional assemblies found in the prior art are firmly restrained by a caulking strip 120 between the outer ring 116 and a groove 118 in the inner cylinder of the turbine 111. In this configuration, the stationary blade assembly 110 is tightly locked in place, creating a hard attachment between each stationary welded blade assembly 110 and the inner cylinder ring 111. In this configuration, the upper and lower 180° segmental assemblies, formed of a semi-circle of stationary blade assemblies 110, are not attached to each other when assembled into a turbine. FIG. 2 also illustrates the attachment of the exhaust flow guide 125 by means of the bolted connection 130 between the flow guide 125 and a portion of the inner cylinder 111 and also illustrates the tip portion 142 of a rotational blade 140. It should be noted that, in conventional designs, the tip 142 of the rotational blade 140 is designed to provide sufficient clearance from the exhaust flow guide 125, which may be deformed along with the inner cylinder 111 during operation. The stationary blades 114 that are disposed upstream from the last blade create a seal against the cylinder 111. The cylinder 111 is subject to thermal distortions which adversely affect the seal clearance.

Figure 3:
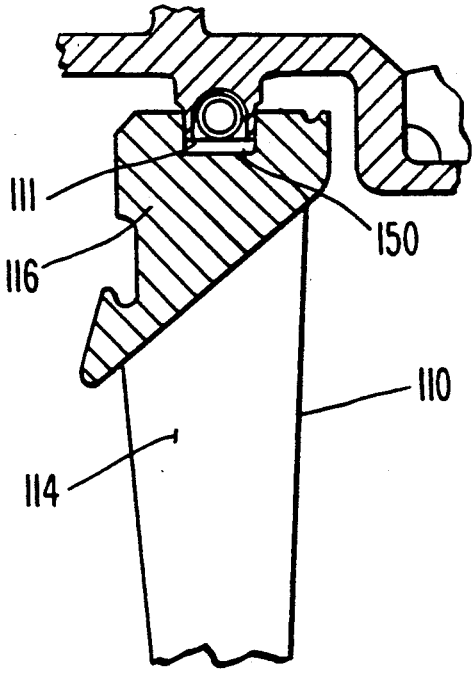
PRIOR ART Fig. 3
FIG. 3 depicts a partially broken away view of a typical stationary blade assembly affixed to an inner cylinder using support blocks and button keys.

An alternate construction also known in the prior art is shown in FIG. 3. As described above, segmental assemblies comprised of stationary blade assemblies 110 are typically assembled as two half-sections. However, in this type of assembly, the half-sections are supported by support blocks 150 bolted to the inner cylinder 111. The assembly is positioned axially by a tongue and groove fit and centered transversely by a button key, alignment dowel, or similar means. In the configuration illustrated in FIG. 3, thermal deformation results from the lack of continuity over the radial path from the axis of the turbine outward, and causes ovality, since the upper and lower sections of the welded blade assembly 110 are not bolted together. The resulting pressure loading and radial thermal gradients cause the distal ends of each section of the assembly to spread apart and deflect radially. This causes clearance problems similar to those occurring in the caulked construction discussed above and illustrated in FIG. 2.

Figure 4:
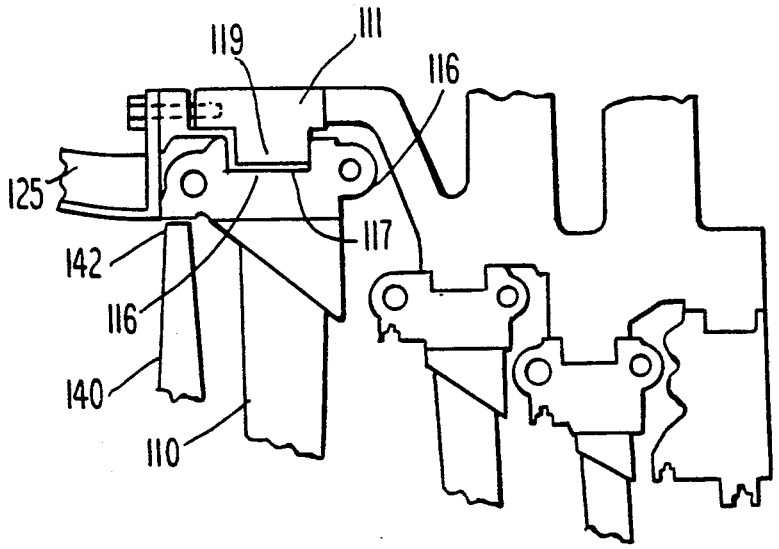
FIG. 4 is a partially broken away side elevation view of a stationary blade assembly made in accordance with the present invention using an integral outer ring.

The present invention overcomes the limitations of the prior art and solves the problems occurring in both of the above-discussed types of designs. As shown in FIG. 4, the present invention isolates the stationary blade assemblies 110 from the inner cylinder 111, thereby substantially eliminating the transfer of thermal deformation. Although isolated in the sense that the thermal deformation is not transferred, the assemblies disclosed are nevertheless securely mounted within the assembled turbine via conventional bolted connections, dowels and other fastening means, well known in the art. In a preferred embodiment illustrated, the present invention provides a tongue 119 on the inner cylinder 111, and a groove 117 in the outer ring 116 of the stationary blade assembly 110 and thereby forms a free-floating interface, shown by the exaggerated gap in FIG. 4, thereby accommodating thermal expansion. As shown, the outer ring 116 is preferably machined as a single integral component, providing a simple, more rugged embodiment which avoids problems ensuing from welding, e.g., weld strength, weld size, fatigue cracking due to residual stress, etc. The outer ring 116 of this embodiment of the present invention also permits the tip 142 of the rotational blade 140 to be precisely positioned relative to the outer ring 116 rather than the exhaust flow guide 125, thereby providing a more reliable construction capable of holding tighter tolerances during operation. Moreover, the flow guide 125 can now be attached to the outer ring 116, rather than the inner cylinder 111, as shown in FIG. 2. By detaching the flow guide 125 from the inner cylinder 111, thermal deformation of that structure is minimized.

Figure 5:
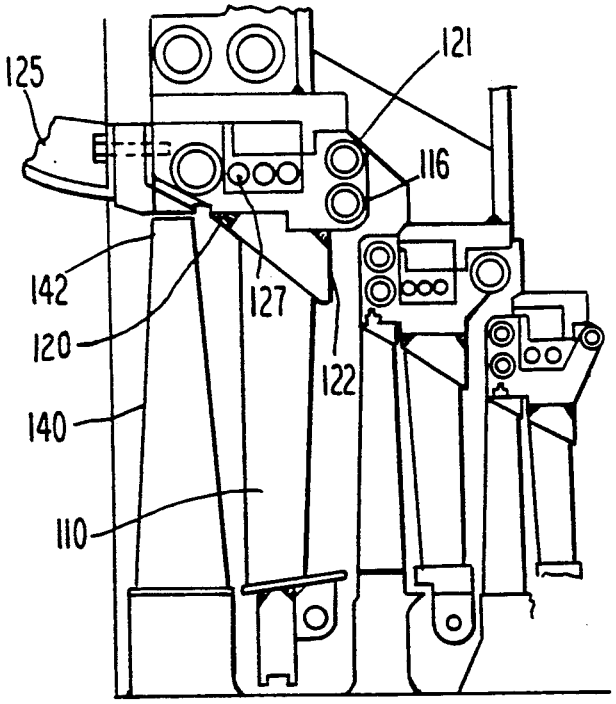
FIG. 5 illustrates another embodiment of a stationary blade assembly made in accordance with the present invention using a welded outer ring.

Although an integral machined assembly represents a preferred embodiment of the present invention, other embodiments which utilize a welded connection are also provided, as illustrated in FIG. 5. In these welded embodiments, the outer ring 116 of the stationary blade assembly 110 is formed using a separate outer ring 121 and inner ring 122 which are then joined together to form an outer ring assembly 116 having a structure similar to that of the solid, machined embodiment illustrated in FIG. 4. There are a variety of design and cost criteria which will make the welded embodiments of the present invention useful. As will be readily understood by those of ordinary skill, the selection between the welded embodiment and the machined configuration will be largely determined by considerations of manufacturing ease, material availability and cost considerations for a particular application. In these embodiments the exhaust flow guide 125 may again be attached to the outer ring 116, as illustrated in FIG. 5, rather than being attached to the inner cylinder 111, as shown in FIG. 2.

In either of the embodiments discussed above, the present invention also provides means for attaching the 180° segmental assemblies together to form a circular structure. Preferably, a dual plane joint, described below, is used to effect this attachment. Detachable support keys 127, illustrated in FIG. 5 (and omitted from FIG. 4) are used in either embodiment to support the assembly. Additionally, as known to those of ordinary skill in the art, adjustable liners may be provided in certain embodiments to permit elevation adjustment. Most preferably, the support keys 127 used in the present invention will be similar to those used for the separate blade rings in the inner blade rows of current turbine designs, as discussed above. Finally, in either embodiment, transverse position may be maintained by any of the variety of anchoring devices also well known to those of ordinary skill and commonly used for blade rings and diaphragms.

Figure 6:
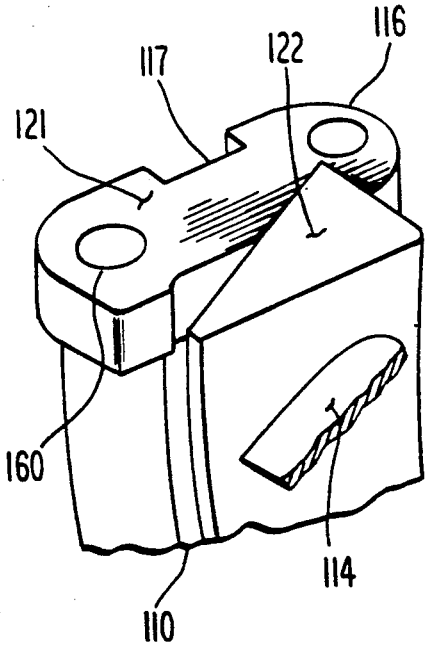
FIG. 6 is a broken away isometric view of a portion of the outer ring of the present invention, illustrating a dual plane bolted connection.

Referring now to FIG. 6, the dual plane bolted joint common to both the welded and integral machined embodiments of the present invention described above with reference to FIGS. 4–5 is illustrated. The term "dual plane" refers to a construction of the joint between the upper and lower one-half turbine sections 100, the latter being illustrated in FIG. 1. The outer parts 121 of the outer ring sections 116 of the stationary blade assemblies 110 meet as horizontal surfaces. On the other hand, surfaces of the inner parts 122 of the outer ring sections 116 meet obliquely at the point of attachment, preferably at an angle of approximately 45°±5°, to accommodate the attachment position of the blade foil 114. This feature presents another advantage of the present invention, in that it is now possible to attach the upper and lower one-half-sections of the stationary blade assemblies 110 (i.e., each of the segmental 180° assemblies) using a bolted horizontal joint. Preferably, the bolted connection would be formed using two horizontal joint bolting points 160 on each side of the assembly. These horizontal joint bolting points 160 are most preferably disposed near the leading and trailing edges of the stationary blade assembly 110, as shown. The use of a bolted joint permits the assembled ring to behave axisymmetrically and therefore results in the joined assemblies functioning as a 360° assembly. This prevents both thermal and pressure induced deformation under transient conditions.

Figure 6A:
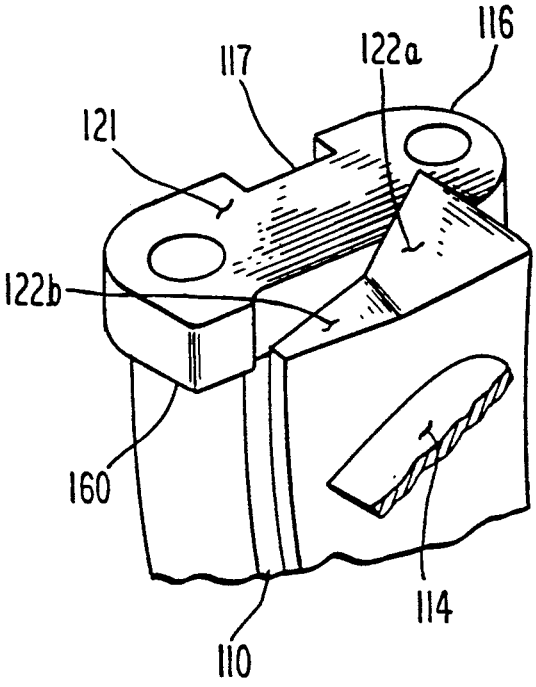
FIG. 6A is a broken away isometric view of a portion of the outer ring of an alternate embodiment of the structure depicted in FIG. 6.

Alternatively, as shown in FIG. 6A, the dual plane bolted joint illustrated in FIG. 6 may be modified so that the inner parts 122 of the outer ring sections 116 meet at an oblique surface which is comprised of two distinct mating planes 122*a*, 122*b*. This "kink" in the mating surface nearest the blade foil 114 provides structural stability and improved alignment of the outer ring sections 116. Those of ordinary skill will appreciate that any number of additional "planes," "kinks," or other structural features which would create a mating surface between the opposing sides of the outer ring sections 116 could be added.

As set forth above, the present invention provides the significant advantage of minimizing pressure and thermal deformation in the welded blade assemblies by preventing the transfer of deformation from the inner cylinder 111. Referring again to FIGS. 5–6, in the present invention, it is now possible to design the clearance between the outer ring 116 of the stationary blade assemblies 110 and the rotational blades 140 based upon the clearance optimally required, rather than using the clearance between the blade tips 142, and the flow guide 125 or inner cylinder 111, as is typically done. This altered design consideration is brought about because the outer ring 116 of the stationary blade assembly 110 will not be subject to non-axisymmetric thermal deformation. Thus, the present invention eliminates the extra clearance margin designed into current turbines to account for ovality or non-axisymmetric behavior and instead permits the blade tip clearances to be designed for optimum efficiency.

Also, as will be readily appreciated by those of ordinary skill, the stationary blade assemblies 110 disclosed above can be quickly and easily removed from the cylinder, thereby permitting better access for repair, maintenance and inspection. It is now possible to more efficiently perform operations such as close inspection of blade foils and ring-to-blade welds. Such inspections may be performed visually or using magnetic particle or dye penetrant techniques to inspect for cracking, pitting, erosion and consequential damage. It has been estimated that utilizing the construction disclosed by the present invention cuts the time to perform and inspection from over sixteen hours in the case of caulked assemblies to less than two hours.

Other advantages of the present invention include permitting the independent adjustment of separate stationary blade assemblies 110, which have been joined into 180° segmental assemblies, within the inner cylinder 111. Formerly, the elevation of the entire inner cylinder 111 had to be changed, leading to less than optimum elevation settings for individual blade rows. Also, the change in the support fixity permits the natural frequency of the welded stationary blade assemblies 110 to be more accurately calculated, thereby allowing them to be tuned to prevent a natural frequency from occurring at the running speed, e.g., 50–60 Hz for a fossil fuel steam turbine, 25–30 Hz for a turbine used in nuclear applications.

In terms of manufacturing, both the welded and machined embodiments of the present invention use conventional production methods and equipment. However, it will be appreciated that each segmental assembly comprised of a plurality of blades foils 114 assembled to inner and outer blade rings 112, 116 can be manufactured independently of the cylinder and at a different manufacturing site, creating the potential for cost savings. Finally, the nature of the present invention admits to its being included in both newly manufactured turbines as well as being used in a retrofit of existing steam turbines, both those used for nuclear power generation and low pressure fossil fuel turbines.

Although certain embodiments of the present invention have been set forth with particularity and described above, these embodiments are illustrative of the general concepts disclosed herein. Numerous variations and adaptations which are within the spirit of the present invention will immediately present themselves to those of ordinary skill. Accordingly, reference should be made to the appended claims to determine the full scope of the present invention.

We claim:

1. A steam turbine comprising:

(a) a plurality of stationary blade assemblies, each comprising:

(i) an inner ring section;

(ii) an outer ring section having a circumferential groove and at least two mating surfaces joined by bolted connections which comprise two planes of engagement formed upon said mating surfaces; and (iii) a plurality of blade foils;

(b) an inner cylinder comprising a plurality of circumferential tongue means for supporting the stationary blade assemblies disposed therein; and (c) a plurality of rotational blades, said stationary blade assemblies being disposed within said inner cylinder, whereby one of the tongue means and grooves are assembled together leaving a clearance therebetween to substantially eliminate the transfer of deformation from the inner cylinder to said stationary blade assemblies.

2. The steam turbine of claim 1, wherein said outer ring section is an integral assembly.

3. The steam turbine of claim 1, wherein the outer ring is a welded assembly comprising an outer part and an inner part joined by one or more substantially continuous circumferential welds.

4. The steam turbine of claim 1, wherein at least one of said mating surfaces is aligned with a horizontal axis of the turbine and another of said mating surfaces is disposed at an angle of between about 40 degrees and 50 degrees from the horizontal axis.

5. A stationary blade assembly comprising an inner ring, an outer ring and a plurality of blade foils therebetween, said assembly being formed of two 180° sections joined at two connections, each of said connections being formed by two mating surfaces formed on opposing sections of the outer ring wherein said two mating surfaces are disposed in two distinct planes.

6. The blade assembly of claim 5, wherein the connections comprise bolted connections.

7. The steam turbine of claim 5, wherein at least one of said mating surfaces is aligned with a horizontal axis of the turbine and another of said mating surfaces is disposed at an angle of between about 40 degrees and 50 degrees from the horizontal axis.

* * * * *